US006324766B1

(12) United States Patent
Schooley

(10) Patent No.: US 6,324,766 B1
(45) Date of Patent: Dec. 4, 2001

(54) CLAMP FOR SECURING A RULER TO A GUIDE

(75) Inventor: Jack M. Schooley, 2014 NE. 155 Ave., Vancouver, WA (US) 98684

(73) Assignees: Jason R. Crowe; Jack M. Schooley, both of Vancouver, WA (US)

( * ) Notice: Subject to any disclaimer, the term of this patent is extended or adjusted under 35 U.S.C. 154(b) by 0 days.

(21) Appl. No.: 09/428,685

(22) Filed: Oct. 27, 1999

(51) Int. Cl.[7] ..... B43L 13/02
(52) U.S. Cl. ..... 33/42; 83/455
(58) Field of Search ..... 33/32.2, 32.3, 33/42.464, 484; 30/286, 289; 83/454, 455, 613, 614, 640, 642, 745, 821, 829

(56) References Cited

U.S. PATENT DOCUMENTS

| | | | | |
|---|---|---|---|---|
| 3,174,225 | | 3/1965 | Abraham . | |
| 3,886,657 | * | 6/1975 | Fabian | 30/289 |
| 3,973,459 | * | 8/1976 | Stowe | 83/455 |
| 3,996,827 | * | 12/1976 | Logan | 83/455 |
| 4,158,977 | * | 6/1979 | Logan | 83/614 |
| 4,903,409 | | 2/1990 | Kaplan et al. | 33/42 |
| 4,949,462 | | 8/1990 | Spencer | 33/42 |
| 5,048,189 | | 9/1991 | Aurness et al. . | |
| 5,103,566 | | 4/1992 | Stebe | 33/27.03 |
| 5,272,947 | * | 12/1993 | Peters | 83/455 |
| 5,307,716 | * | 5/1994 | Onishi et al. | 83/614 |
| 5,309,642 | | 5/1994 | McGinnis | 33/32.2 |
| 5,471,753 | | 12/1995 | Rodrigues | 33/42 |
| 5,600,892 | | 2/1997 | Peugh et al. . | |
| 5,732,472 | | 3/1998 | Praye | 33/42 |
| 6,182,549 | * | 2/2001 | Albright et al. | 83/454 |

* cited by examiner

*Primary Examiner*—G. Bradley Bennett
(74) *Attorney, Agent, or Firm*—Owen W. Dukelow; Kolisch Hartwell Dickinson McCormack & Heuser

(57) ABSTRACT

A clamp structure includes a frame defining an aperture through which an elongate member extends. A shoe is fitted in a channel of the elongate member and is of external cross-section substantially complementary to the cross-sectional configuration of the channel. A mechanism forces the shoe into the channel and firmly presses the elongate member against the frame.

5 Claims, 2 Drawing Sheets

CLAMP FOR SECURING A RULER TO A GUIDE

BACKGROUND OF THE INVENTION

This invention relates to a clamp, particularly for securing a ruler to a guide.

When working with gypsum wall board panels, it is frequently necessary to score a panel along a line that is accurately parallel to an edge of the panel. This can be done by measuring from the edge of the panel at two locations, marking the panel, setting a straight edge between the marks, and running a knife along the straight edge. However, this is a time consuming and inaccurate operation.

Various guide mechanisms have been proposed for facilitating scoring of wallboard. For example, Kaplan et al, U.S. Pat. No. 4,903,409, discloses a scoring tool which includes a guide that runs against the edge of the panel and a ruler that projects from the guide and overlies the surface of the panel. A knife is fitted to the ruler and is adjustable in position lengthwise of the ruler by releasing and engaging a clamp which receives a knife holder. Also, Peugh et al, U.S. Pat. No. 5,600,892, discloses a drywall panel cutter having a guide which engages the edge of the panel and a ruler which projects perpendicular to the guide and is moveable lengthwise by releasing and engaging a clamp. At one end, the ruler carries a tool for scoring the drywall panel.

The clamps used in wall board scoring and marking tools are generally unsatisfactory and do not hold the ruler firmly relative to the guide or hold the knife holder firmly relative to the ruler.

SUMMARY OF THE INVENTION

In accordance with a first aspect of the invention there is provided a clamp structure for securing an elongate first member having a channel of uniform cross-sectional configuration to a second member, the clamp structure including a frame defining an aperture through which the first member extends, a shoe fitted in the channel and of external cross-section substantially complementary to the cross-sectional configuration of the channel, and a mechanism which forces the shoe into the channel and firmly presses the first member against the frame.

In accordance with a second aspect of the invention there is provided a clamp structure for securing a V-section first member to a second member having a flat surface, comprising a frame attached to the second member and having a first length segment inclined to the flat surface of the second member and a second length segment joining the first length segment to the second member, whereby the frame and the second member define an aperture for receiving the V-section member, a V-section shoe fitted in the channel of the V-section member, and a mechanism urging the shoe firmly into the channel, whereby the V-section member is pressed firmly against the first length segment of the frame and the flat surface of the second member.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
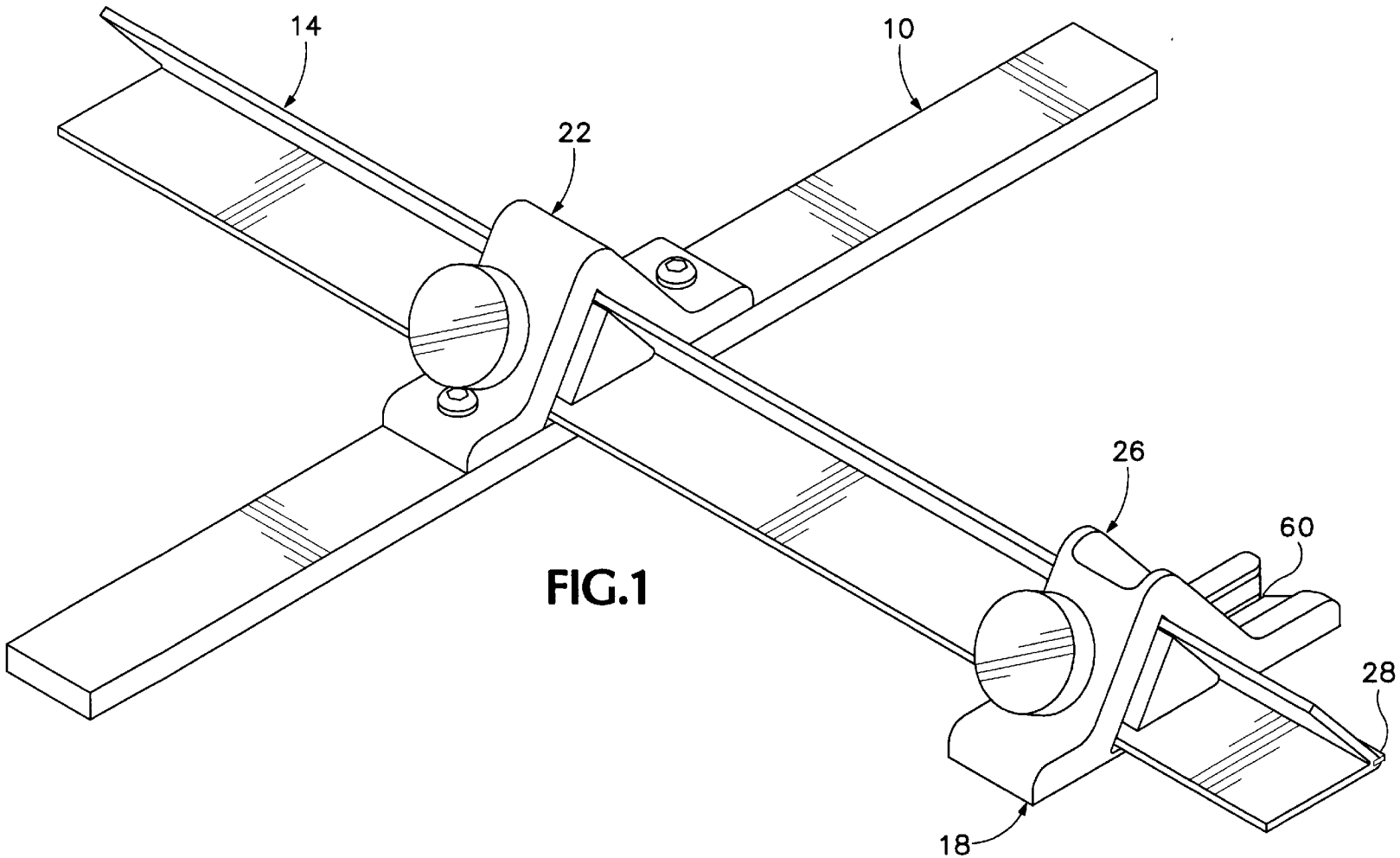
FIG. 1 is a perspective view of a wall board scoring tool including two clamp structures in accordance with the present invention.
Figure 2:
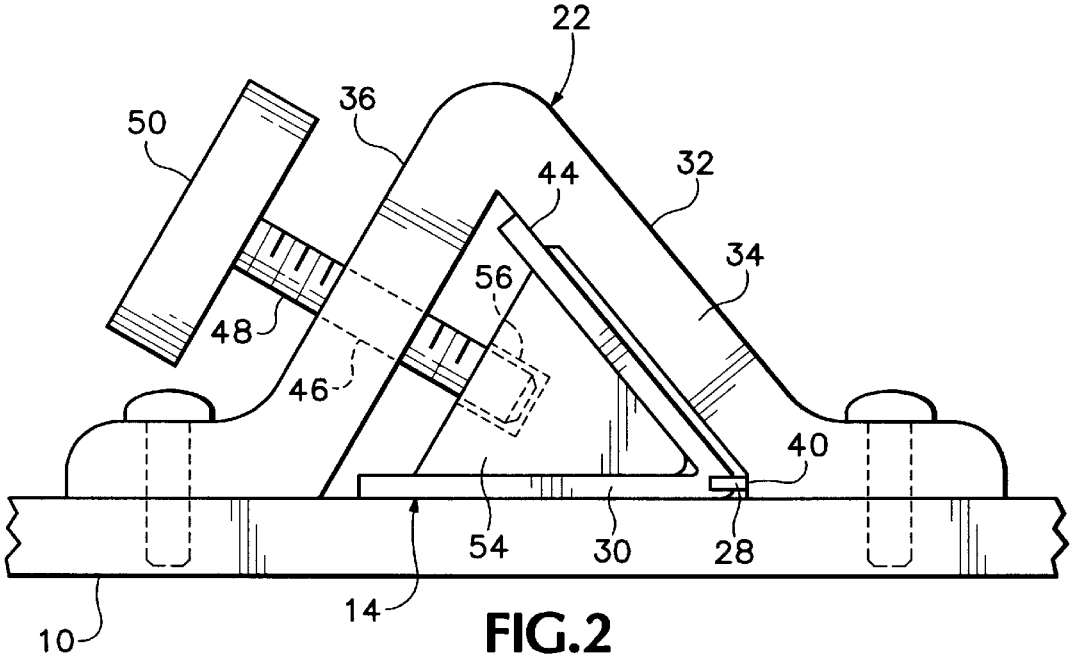
FIG. 2 is a sectional view of one of the clamp structures.

The wall board scoring tool illustrated in the drawings comprises a rectangular section guide bar 10, a ruler 14 and a knife rest 18. The ruler 14 is attached to the guide bar 10 by a clamp structure 22 and the knife rest 18 is attached to the ruler 14 by a clamp structure 26. The ruler 14 is of uniform cross-section over its length. The ruler is V-shaped in external cross-section, the two main external faces of the ruler being at an acute angle $\alpha$. The ruler has a V-shaped channel defined between two internal faces at an acute angle $\beta$. The angle $\alpha$ is substantially equal to the angle $\beta$. Typically, the guide bar, the ruler and the knife rest are made of anodized aluminum. However, the ruler includes a steel blade 28 embedded in the ruler body 30 at the intersection of the two external faces.

The clamp structure 22 includes a rigid frame 32 which is attached at its two opposite ends to the guide bar 10 and, with the flat top surface of the guide bar, defines a generally triangular opening through which the ruler 14 extends. The frame 32 has a first length segment 34, which is inclined to the flat top surface of the guide bar at an acute angle $\gamma$, which is substantially equal to $\alpha$, and a second length segment 36 substantially perpendicular to the bisector of the angle $\gamma$. The frame includes a small shoulder or abutment surface 40 where the first length segment 34 of the frame meets the guide bar 10 and there is a land 44 toward the upper end of the first length segment 34 of the frame. The second length segment of the frame is formed with an internally threaded hole 46 and a bolt 48 is threadedly received in the hole. The bolt has a knurled turning knob 50 at its outer end.

A V-shaped shoe 54 is seated in the channel of the ruler 14. The shoe has two forward surfaces which are inclined at an internal angle $\delta$ which is substantially equal to $\beta$ and has a rear surface at which it is formed with a blind recess 56, which is sized to receive the inner end of the bolt 48 with a clearance fit. The shoe can be positioned in the channel so that the recess 56 is substantially aligned with the threaded hole 46. When the bolt is advanced in the threaded hole by turning the knob, the inner end of the bolt enters the recess 56. Further advancing of the bolt forces the V-shaped shoe into the channel of the ruler. The two outer surfaces of the shoe are pressed firmly against the two internal faces of the ruler. The shoe presses the ruler firmly into the V-shaped space between the flat upper surface of the guide bar and the first length segment of the frame. In this manner, the lower external face of the ruler is pressed firmly against the guide bar. Further, and depending on the exact dimensions of the ruler, which are subject to manufacturing variations, the steel blade 28 is pressed against the shoulder 40 and/or the upper edge of the upper external face of the ruler is pressed against the land 44. In any case, a firm contact is made both between the ruler and the guide bar and between the ruler and the frame. The contact exists over a significant part of the length of the ruler. Frictional engagement between the ruler and the shoe, between the ruler and the frame and between the ruler and the guide bar holds the ruler firmly against longitudinal movement relative to the guide bar. The ruler is held firmly against both translation and rotation relative to the guide bar.

The clamp structure 26 is similar to the clamp structure 22 and secures the knife rest against movement lengthwise of the ruler and against tilting relative to the ruler.

In use, the user positions the guide bar and the knife rest at a suitable mutual distance along the ruler and tightens the two clamps. The user places the guide bar against one edge of a wall board panel and places a utility knife in the knife rest, with the blade of the knife in the slot 60. The user then runs the guide bar along the edge of the panel while holding the utility knife in the knife rest. The utility knife scores the panel parallel to the edge against which the guide bar is engaged, and runs accurately parallel to the edge.

It will be appreciated that the invention is not restricted to the particular embodiment that has been described, and that variations may be made therein without departing from the scope of the invention as defined in the appended claims and equivalents thereof. In particular, the invention is not restricted to use in a tool for marking or scoring wall board panels and may be used in other applications where it is necessary to hold an elongate first member having a channel of uniform cross-sectional configuration securely relative to a second member. For example, the invention may be used in a layout instrument.

What is claimed is:

1. A clamp structure for securing an elongate first member having a channel of uniform cross-sectional configuration to a second member, the clamp structure including a frame defining an aperture through which the first member extends, a shoe fitted in the channel and of external cross-section substantially complementary to the cross-sectional configuration of the channel, and a mechanism which forces the shoe into the channel and firmly presses the first member against the frame.

2. A clamp structure according to claim 1, wherein the channel is V-shaped in cross-section.

3. A clamp structure according to claim 1, wherein the first member is V-shaped in external cross-section and the frame includes a first length segment inclined to the second member substantially at the angle between the two external faces of the V-shaped external cross-section and a second length segment joining the first length segment to the second member.

4. A clamp structure according to claim 3, wherein said mechanism includes a screw in threaded engagement with the second length segment of the frame and having an inner end engaging the shoe.

5. A clamp structure for securing a V-section first member to a second member having a flat surface, comprising a frame attached to the second member and having a first length segment inclined to the flat surface of the second member and a second length segment joining the first length segment to the second member, whereby the frame and the second member define an aperture for receiving the V-section member, a V-section shoe fitted in the channel of the V-section member, and a mechanism urging the shoe firmly into the channel, whereby the V-section member is pressed firmly against the first length segment of the frame and the flat surface of the second member.

* * * * *